United States Patent [19]

Kirsch et al.

[11] 4,106,594

[45] Aug. 15, 1978

[54] ELEVATOR SYSTEM

[75] Inventors: Andrew F. Kirsch, Edison; Robert W. Koob, Hopatcong, both of N.J.

[73] Assignee: Westinghouse Electric Corp., Pittsburgh, Pa.

[21] Appl. No.: 785,978

[22] Filed: Apr. 8, 1977

[51] Int. Cl.[2] ..... B66B 13/24

[52] U.S. Cl. ..... 187/29 R

[58] Field of Search ..... 187/29

[56] References Cited

U.S. PATENT DOCUMENTS

| | | | |
|---|---|---|---|
| 3,783,978 | 1/1974 | Hamilton | 187/29 X |
| 3,791,490 | 2/1974 | Smith | 187/29 |
| 4,011,928 | 3/1977 | Spear et al. | 187/29 |
| 4,056,169 | 11/1977 | Showalter | 187/29 |
| 4,069,898 | 1/1978 | Tosato et al. | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including apparatus for detecting mechanical damage to the elevator system, such as might be caused by an earthquake. A cable strung in the hoistway is reeved about a plurality of sheaves carried by the counterweight. Normal operation of the counterweight maintains a predetermined tension in the cable, which predetermined tension is used to maintain a switch in a first condition. Abnormal movement of the counterweight outside of its vertical travel path changes the tension in the cable and operates the switch to a second condition which modifies the operation of the elevator system.

7 Claims, 6 Drawing Figures

FIG.1
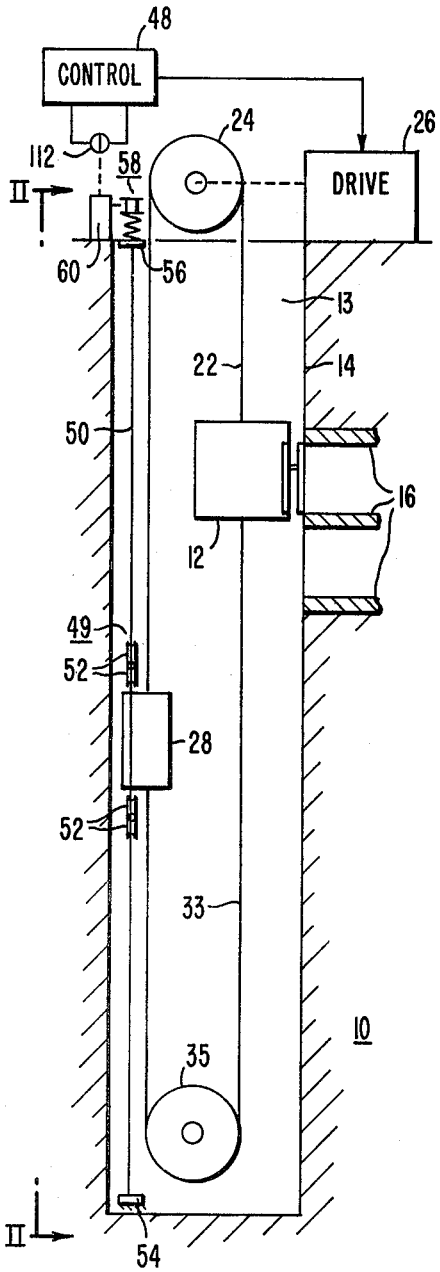
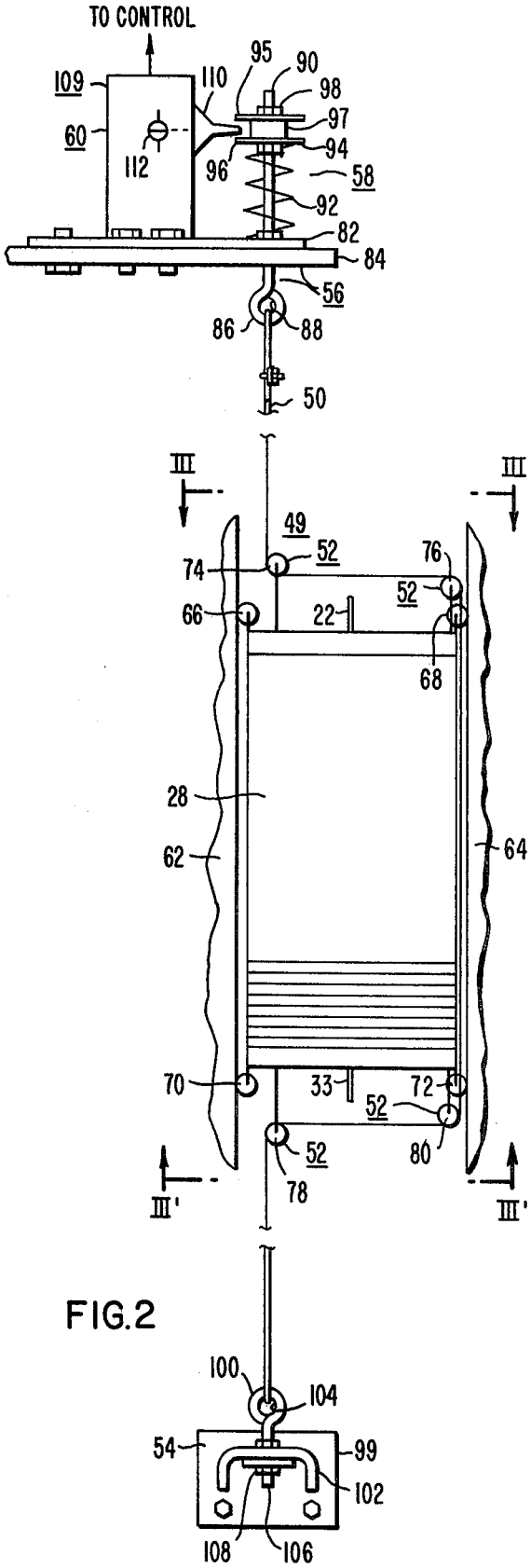
FIG.2

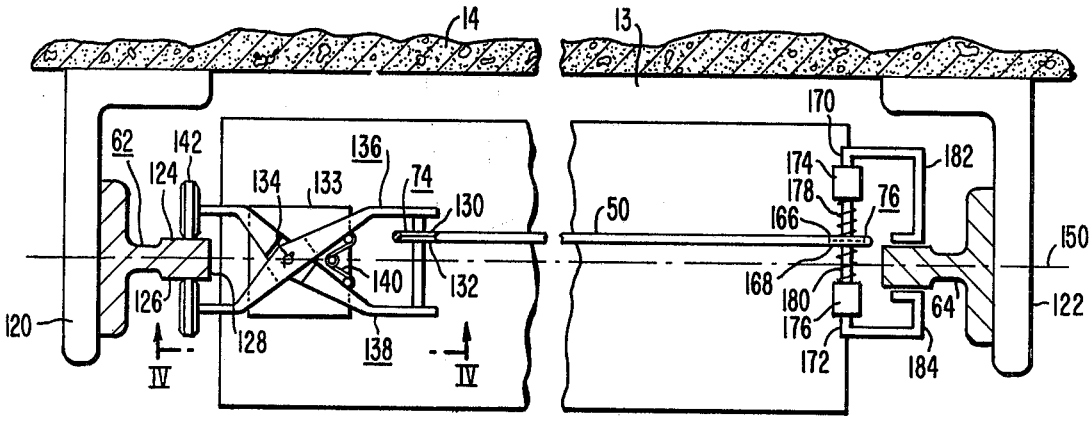
FIG.3
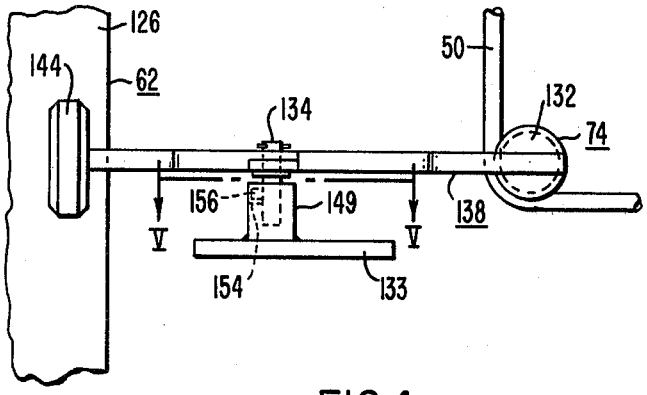
FIG.4
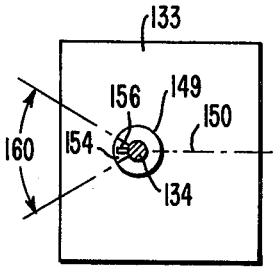
FIG.5
FIG.6
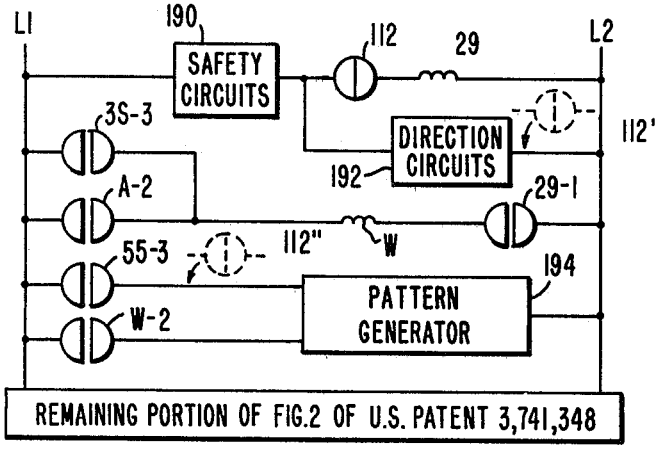

ELEVATOR SYSTEM

BACKGROUND OF THE INVENTION

1. Field of the Invention

The invention relates in general to elevator systems, and more specifically to elevator systems which include controls for detecting damage to the elevator system, such as caused by an earthquake, and then modifying the operation of the elevator system.

2. Description of the Prior Art

U.S. Pat. No. 3,792,759, which is assigned to the same assignee of the present application, discloses a dual level detector arrangement for an elevator system in which at least the first level of detection is responsive to acceleration forces applied to the associated building. The two detection levels are arranged to provide an early warning of earthquake, without nuisance service outages. The second level of detection may be responsive to acceleration forces of a higher magnitude than the first level of detection, or it may be responsive to mechanical damage to the elevator system, such as displacement of the counterweight from its guides.

U.S. Pat. Nos. 3,783,978; 3,791,490; 3,815,710; and 3,896,906 disclose different arrangements for detecting actual or possible damage to an elevator system, which include (a) detecting the interruption of a sliding or rolling electrical contact maintained between a movable component of the elevator system and a wire or track in the hoistway, (b) detecting the mechanical contact between a conductive ring disposed on a movable component of the elevator system and a vertical wire which extends the length of the hoistway on the normal center line of the conductive ring, and (c) detecting mechanical contact between a plumb bob and an encircling metallic ring arrangement, both of which are carried by one of the movable components of the elevator system.

Copending Application Ser. No. 584,431 filed June 6, 1975, now Pat. No. 4,011,928, which is assigned to the same assignee as the present application, discloses a damage detector for an elevator system which utilizes a transmitter of radio frequency energy and a receiver thereof.

Copending Application Ser. No. 710,970 filed Aug. 2, 1976 now Pat. No. 4,069,898 , which is assigned to the same assignee as the present application, discloses a damage detector for an elevator system which includes a signal generator on the counterweight which is inductively coupled with a wire strung the length of the hoistway.

Copending application Ser. No. 693,986, filed June 8, 1976, which is assigned to the same assignee as the present application, discloses a damage detector for an elevator system which includes an elongated element disposed in the hoistway, and means carried by the counterweight for severing the element in response to abnormal movement of the counterweight.

While these prior art arrangements are effective in detecting actual or possible mechanical damage to the elevator system, it would be desirable to provide a new and improved arrangement for detecting damage to an elevator system (a) which eliminates the need for connecting a traveling cable to the counterweight, (b) which does not depend upon detecting mechanical contact between two sensors, (c) which does not depend upon the transmission and receiving of radio frequency energy, (d) which does not require continuous mechanical and electrical contact between a movable member and a statinary track or wire which runs the length of the hoistway, (e) which does not require a battery on the counterweight, and (f) which may be reset upon actuation without replacing any parts.

SUMMARY OF THE INVENTION

Briefly, the present invention is a new and improved elevator system which detects mechanical damage to one of its movable components, such as displacement of the counterweight from its guides, without requiring an electrical traveling cable or a battery on the counterweight, the detection of mechanical contact between two sensors, a continuous mechanical and electrical connection between the counterweight and a special conductive track in the hoistway, or the replacement of parts in order to reset the detector after actuation. A steel cable is strung the length of the hoistway about a plurality of sheaves carried by the counterweight. The ends of the cable are fixed, and a prdetermined tension is developed in the cable. As long as the counterweight does not deviate abnormally from its vertical travel path, the predetermined tension is maintained. An abnormal lateral deviation of the counterweight from its vertical travel path either increases or decreases the tension in the cable. A detector located remote from the counterweight monitors the tension in the cable. The detector includes a control device, such as a switch, or an electro-mechanical relay, which has one or more sets of contacts connected in the elevator drive control, or a solid state device connected to modify the elevator drive control when operated to a predetermined state. When the counterweight is operating in its normal vertical travel path, the detector maintains the control device in a condition which has no affect on the elevator drive control. If the counterweight is dislodged from its normal vertical travel path, the detector will operate the control device to modify the operation of the elevator system, such as by preventing a stationary car from starting, and by stopping a moving car with or without regard to its stopped position relative to a floor level, as desired.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 1 is a diagrammatic view of an elevator system constructed according to the teachings of the invention;

FIG. 2 is a more detailed view of the counterweight shown in FIG. 1, taken in the direction of arrows II—II shown in FIG. 1;

FIG. 3 is a plan view of the counterweight shown in FIG. 2 taken in the direction of arrows III—III, or III'—III', in FIG. 2, which illustrates cable guides constructed according to the teachings of the invention;

FIG. 4 is an elevational view of one of the cable guides shown in FIG. 3, taken in the direction of arrows IV—IV of FIG. 3;

FIG. 5 is a plan view of a portion of the cable guides shown in FIG. 4, taken in the direction of arrows V—V; and FIG. 6 is a schematic diagram of elevator control which is modified according to the teachings of the invention.

DESCRIPTION OF PREFERRED EMBODIMENTS

Referring now to the drawings, and to FIG. 1 in particular, there is shown an elevator system 10 constructed according to the teachings of the invention. Elevator system 10 includes an elevator car 12 mounted for movement in the hoistway 13 of a building or structure 14 having a plurality of floors or landings 16. The elevator car 12, which is guided in a vertical travel path by suitable guide rails (not shown) is supported by a plurality of wire ropes 22 in the hoistway 13, with the ropes 22 being reeved over a traction sheave 24 mounted on the shaft of suitable motive means, such as a drive motor 26. A counterweight 28, guided in a vertical path by suitable guide rails (not shown in FIG. 1) is connected to the other ends of the ropes 22. Compensation ropes 33 interconnect the bottoms of the elevator car 12 and counterweight 18 via a compensator sheave 34 disposed in the pit or bottom of the hoistway 13.

The drive motor 26 drives the sheave 24 in response to elevator drive control, shown generally at 48. According to the teachings of the invention, the control 48 is modified when damage to the elevator system is detected by a new and improved damage detection system 49 which includes a cable 50 strung the length of the hoistway 13, which is reeved about a plurality of sheaves 52 carried by the counterweight 28. The lower end of the cable 50 is fixed or anchored in pin at 54, and the other end is anchored at the top of the hoistway at 56, via tension means 58. A detector 60 located remotely from the counterweight, such as in the machine or motor room is responsive to the tension in the cable 50, such as by monitoring the tension means 58.

A plurality of damage detector devices (not shown in FIG. 1) are disposed on the counterweight 28 to detect abnormal horizontal movement of the counterweight, with each of the detector devices including means for changing the tension in the cable 50. As will be hereinafter described, the damage detector devices in a preferred embodiment of the invention including sheaves 52 which are split into two portions, with the two portions being biased together. The damage detector devices overcome the bias to release the cable 50 from a sheave, and thus change the tension in the cable.

FIG. 2 is an elevational view of the counterweight 28 and the damage detector system 49 shown in FIG. 1, taken in the direction of arrows II—II. FIG. 2 illustrates the counterweight 28 and damage detector system 49 in more detail, and sets forth a preferred embodiment of the invention.

More specifically, FIG. 2 illustrates the counterweight 28 mounted for guided vertical movement relative to first and second spaced guide rails 62 and 64, respectively, via guide roller assemblies 66, 68, 70 and 72. The guide roller assemblies are mounted at the four corners of the counterweight 28, and they co-act with the guide rails 62 and 64 to guide the counterweight 28.

The plurality of sheaves 52 which are carried by the counterweight 28 may include first and second sheaves 74 and 76, respectively, mounted on the top portion of the counterweight, and first and second sheaves 78 and 80, respectively, mounted on the bottom portion of the counterweight. The cable 50 extends upwardly from anchor 54, it is reeved over sheave 78 located adjacent to the lower left-hand corner of the counterweight, and this sheave directs the cable to sheave 80 located at the lower right-hand corner of the counterweight. Sheave 80 directs the cable 50 vertically upward in spaced relation from the right-hand edge or side of the counterweight 28 to a sheave 76 located at the upper right-hand corner of the counterweight. The cable 50 is reeved over sheave 76, and sheave 76 directs the cable under sheave 74 located at the upper left-hand corner of the counterweight. Sheave 74 directs the cable 50 to the upper anchor 56 and associated tensioning means 58.

The upper anchor 56 and tensioning means 58 may include a mounting plate 82 mounted on the floor 84 of the machine room, an eye bolt 86 which is inserted through aligned openings in plate 82 and floor 84 such that the eye portion 88 is below the floor 84 and its threaded shank portion 90 extends above the mounting plate 82. A coil spring 92 is telescoped over the upstanding shank portion 90, and a spring seat 94 is disposed over the shank portion 90 to contact the upper end of the spring 92. First and second actuating figures 95 and 96, and a spacer 97, are placed over the spring seat and the nut 98 secures the components in assembled relation.

The cable 50 is secured to the eye portion 88 of the eye bolt and it is reeved about sheaves 74, 76, 80 and 78 on the counterweight 28 as it makes its way to the lower anchor 54.

The lower anchor 54 includes a mounting plate 99 which is fixed in the hoistway 13 and an eye bolt 100 which is fixed to the mounting plate 99 such as via structural member 102 which is welded or otherwise secured to the mounting plate. The eye bolt 100 extends through an opening in structural member 102, with the eye portion 104 of the eye bolt 100 facing the counterweight 28 and with the threaded shank portion 106 extending below the structural member 102. A nut 108 is engaged with the threaded shank portion 106 of the eye bolt. The cable 50 is secured to the eye portion 104 and the nut 106 is advanced to provide the desired tension in cable 50, which tension compresses spring 92 to a point which is about midway to its piped condition.

The detector 60 is responsive to the tension in the cable 50. With the counterweight 28 properly within its guides, the cable 50 may be adjusted to provide a predetermined tension, the magnitude of which is reflected by the amount of compression of the spring 92 and the positions of the fingers 95 and 96. The detector 60 may be constructed to detect only cable slack, i.e., a reduction in cable tension, or it may be constructed to detect both an abnormal reduction and an abnormal increase in cable tension. A reduction in cable tension may be achieved in response to system damage by utilizing split sheaves for guiding the cable on the counterweight 28, with the two portions of each split sheave normally being biased together. Misalignment of the counterweight 28 relative to its guide rails is sensed by actuators linked to the two halves of each split sheave, with the actuator overcoming the bias to separate the sheave halves and allow the cable to become slack. FIGS. 3, 4 and 5 illustrate an embodiment of the invention which utilizes split sheaves.

An increase in cable tension may be due to misalignment of the counterweight relative to the guide rails. If the split sheave arrangement is utilized, but it fails to release the cable properly, or the cable becomes snagged, the cable tension will also be increased.

If only cable slack is to be detected, the spring 92 may be compressed to the point of urging two electrical contact elements together, which remain in a closed condition as long as the cable tension exceeds a predetermined magnitude. When abnormal cable slack occurs, the spring separates the contact elements, and the open set of contacts provides a signal for modifying the operation of the elevator system, such as by stopping a moving car and by preventing a stationary car from starting. If both cable slack and increased cable tension are to be detected, the arrangement shown in FIG. 2 may be used. The fingers 95 and 96 at the end of spring 92 are spaced by a distance which is sufficient to accommodate normal changes in cable tension as the counterweight moves in its normal vertical travel path. The detector 60 includes a centered double throw switch 109 having an actuating lever 110 and at least one set of contacts 112. Contacts 112 are closed when lever 110 is centered, and they open when the lever 110 moves off center in either direction. Depending upon how the contacts 112 are to be utilized in the control circuitry of the elevator system, they could also be normally open instead of normally closed, and additional sets of contacts, either normally open or normally closed may be actuated by the lever 110. A single set of contacts 112 may also be used to pick up, or drop out an associated electromagnetic relay having one or more sets of contacts connected in the elevator control circuit. An arrangement for utilizing contacts 112 to modify the operation of the elevator system 10 shown in FIG. 1 will be hereinafter described relative to FIG. 6.

FIGS. 3, 4 and 5 illustrate a preferred embodiment of the invention in which the sheaves 74, 76, 78 and 80 used to guide the cable 50 relative to the counterweight are of split construction. FIG. 3 is a top or plan view of the counterweight 28 taken between and in the direction of arrows III—III in FIG. 2. The view shown in FIG. 3 would also be similar to that of the bottom of the counterweight, such as taken between and in the direction of arrows III'—III' in FIG. 2. In other words the sheave 74 and its cable release mechanism may be similar to the construction of sheave 78 and its cable release mechanism, and sheave 76 and its cable release mechanism may be similar to sheave 80 and its cable release mechanism.

More specifically, each of the counterweight guide rails 62 and 64 are attached to suitable mounting brackets 120 and 122, respectively, which extend in spaced relation from the wall of the hoistway 13. Each guide rail, such as guide rail 62, includes first and second opposed side guide surfaces 124 and 126, and a face or nose guide surface 128.

The cable release mechanism or sheave 74, which is a split sheave having first and second portions 130 and 132, includes a scissors arrangement having a base 133, a pivot pin 134 mounted on base 133, first and second pivotable scissor arms or members 136 and 138 mounted for rotation on the pivot pin 134, and a torsion spring 140. A pair of elastomeric rollers 142 and 144 are journaled for rotation on like ends of the pivotable members 138 and 136, respectively. The two portions 130 and 132 of the sheave are mounted on the opposite like ends of members 136 and 138, respectively. The torsion spring 140 is mounted on the sheave side of the pivot pin 134, in a manner which urges the two portions of the split sheave apart, and the rollers 142 and 144 together. The rollers 142 and 144 are urged apart against the bias of the spring 140 when they ride on guide surfaces 124 and 126, respectively, of guide rail 62. When the rollers 142 and 144 are in rolling contact with the guide surfaces 124 and 126 and the center line of pin 134 is on the between-guide center line 150, the two portions 130 and 132 of the sheave 74 will be biased firmly together.

The scissors type cable release mechanism illustrated relative to sheave 74 is constructed to accommodate normal counterweight sway in the manner illustrated in FIGS. 4 and 5. FIG. 4 is an elevational view of the cable release mechanism associated with sheave 74, taken between and in the direction of arrows IV—IV shown in FIG. 3. The pivot pin 134 is pivotally mounted within an upstanding post member 152. The post member 152, in addition to the opening which rotatably receives pin 134, is cut out adjacent its upper end, with the cut-out portion being indicated at 154, to accommodate a small pin member 156 which extends perpendicularly outward from the side of pivot pin 134. The pin 156 extends towards rollers 142 and 144, with its longitudinal center line being on the between-guide center line 150, as illustrated in FIG. 5. FIG. 5 is a plan view of the pivot pin 134 and post member 150, taken between and in the direction of arrows V—V in FIG. 4. The cut-out portion 154 at the top of the post member 150 is in the form of a sector having an angle 160 which is bisected by the between-guide center line 150.

Normal lateral movement of the counterweight 28 in a direction perpendicular to the adjacent wall of the hoistway 13 shown in FIG. 3, is permitted without releasing the cable. When the lateral movement becomes great enough for the pin 156 to contact a side wall portion of the cut-out 154, continued lateral movement of the counterweight will move one of the rollers away from the other and cause one side of the split sheave to move away from the other side to release the cable 50. If the counterweight 28 should move in the direction toward either of its guide rails, such as as that cause the rollers 142 and 144 to ride off of the guide surfaces 124 and 126, the torsion spring will urge the rollers 142 and 144 together and thus open the sheave 74.

The cable release mechanism associated with sheave 76 may be of the same type as the cable release mechanism associated with sheave 74. The fact that sheave 76 must be located adjacent to an edge or side of the counterweight 28 in order to direct the cable 50 in spaced relation alongside of the counterweight complicate the scissors type of arrangement. Thus, as illustrated in FIG. 3, sheave 76 is illustrated with a different type of cable release mechanism. Sheave 76, similar to sheave 74, is of split construction, having first and second portions 166 and 168 mounted on shaft members 170 and 172, respectively. Shaft members 170 and 172 are aligned by stationary or fixed guides 174 and 176, respectively, and the sheave portions 166 and 168 are biased together by spiral springs 178 and 180, respectively. Spring 178 is disposed between fixed guide 174 and sheave portion 166, and spring 180 is disposed between fixed guide 176 and sheave portion 168. Shaft 170 includes a sensor arm 182 disposed in predetermined spaced relation from one of the side guide surfaces of guide rail 64. Shaft 172 includes a sensor arm 184 disposed in predetermined spaced relation from the other of the side guide surfaces. If the counterweight 28 moves in the direction of the between-guide center line 150, the scissors arrangement associated with sheave 74 will release the cable 150. If the counterweight moves away from the rail 64 in a direction perpendicular to the adjacent wall of the hoistway, one of the sensor arms 182 or 184 will contact the guide rail and move its associated sheave portion against the bias of the associated spring. When the spring associated with the other sheave portion is fully extended it will no longer bias its sheave portion against the other sheave portion and the sheave will split to release the cable.

FIG. 6 is a schematic diagram of a portion of an elevator control system, which may be the control system shown generally at 48 in FIG. 1. The control of any elevator system may be modified to operate according to the teachings of the invention. For purposes of example, the elevator control disclosed and described in U.S. Pat. 3,741,348, which is assigned to the same assignee as the present application, will be used to illustrate the invention. Only a portion of the control illustrated in U.S. Pat. No. 3,741,348 which is necessary to understand the present invention is shown, as reference may be had to this patent for additional information, if required.

The relay contacts in FIG. 6 of the present application are identified by hyphenated reference characters. The portion of the reference character before the hyphen identifies the relay with which the contacts are associated, and the number after the hyphen identifies the contacts of the associated relay. All of the relay contacts are shown in their normal position when the relay is deenergized.

As an aid to understanding FIG. 6, the relays and switches are identified as follows:

A — Brake Monitor Relay
W — Pattern Selector Relay
3S — Running Relay
29 — Safety Circuit Relay
55 — Overspeed Relay
112, 112′, 112″ — Damage Detector Contacts The components shown in FIG. 6 may all be mounted in the machine room, such as in the penthouse of the building, or other suitable location remote from the movable components of the elevator system.

Control 48 includes a safety relay 29 connected between electrical buses L1 and L2 via conventional elevator safety circuits, shown generally at 190, and through the normally closed contacts 112 of the switch 109 associated with the detector 60 shown in FIG. 2. The normally closed contacts 112 enable the safety relay 29 to be energized through the normal safety circuits 190 of the elevator system.

Should switch 109 be actuated by one of the fingers 95 or 96 shown in FIG. 2, it contacts 112 will open to drop the safety relay 29. Safety relay 29 has contacts 29-1 which enable the operation of the pattern selector relay W.

The direction circuits, shown generally at 192, are connected to be energized through the safety circuits 190. The pattern selector relay W is energized through contacts 29-1 when the running relay 3S (not shown) is energized, via contacts 3S-3 of the running relay, and it remains energized until the brake is applied, indicated by contacts A-1 of the brake monitor relay A (not shown). Relay W has contacts W2 connected in the circuit of a pattern generator 194.

The pattern generator 194, which is shown in detail in U.S. Pat. No. 3,741,348, energizes solenoids which lift pawls clear of the floor stops located in the pattern generator. The stop relay (not shown) breaks this circuit when energized to stop the car at a landing. The overspeed relay 55 (not shown) is energized through an overspeed switch, which opens at a predetermined percentage of overspeed, such as 10%. The overspeed relay 55 has contacts 55-3 which open when relay 55 drops out, to drop the pawls and thus stop the car at the closest landing at which the car can make a normal stop.

Contacts W-2 of the pattern selector relay are also connected to the pattern generator 194, in a circuit which normally opens when the floor stop of a pattern generator is captured by a dropped pawl. If the safety relay 29 is de-energized, relay W drops to open contacts W-2, which simulates the capturing of a floor stopped by a pawl, stopping the car without regard to its location relative to a landing.

In the operation of the damage detector system, when the damage detector contact 112 opens in response to an abnormal horizontal movement of the counterweight, the safety relay 29, drops, opening its contacts 29-1, and the opening of contacts 29-1 de-engerizes the pattern selector relay W. Contacts W-2 of the pattern selector relay thus open, to immediately initiate slowdown of a moving elevator car. The elevator car thus stops without regard to its stopped location relative to a floor level. A car which is already stopped at a floor when the safety relay 29 is deenergized, cannot be started.

Instead of stopping a moving car without regard to its stopped location relative to a landing level, a moving car may be stopped at the closest landing in its travel direction at which it can make a normal stop, by removing contacts 112 from the safety relay 29 circuit, by adding contacts 112′, shown in phantom in FIG. 6, between the direction circuits 192 and bus L2, which prevents the starting of a stationary car when contacts 112′ are open, and by adding contacts 112″, also shown in phantom in FIG. 6, in series with contacts 55-3. Contacts 112″, when open, will stop a moving car at the closest floor in its travel direction at which it can make a normal stop.

As described in the hereinbefore mentioned U.S. Pat. No. 3,792,759, the speed of the elevator car may be automatically reduced, if desired, by appropriately located contacts from the detector 60.

In summary, there has been disclosed a new and improved elevator system which includes means for detecting damage to a movable component of the elevator system, such as abnormal horizontal movement of the counterweight, and means responsive to such detection for modifying the operation of the drive control of the elevator system. The means for detecting damage includes a steel cable, which is stretched through the hoistway by fixing end of the cable in the pit, and by reeving the cable through sheaves carried by the counterweight, and by fastening the other end of the cable to a tension assembly at the top of the hoistway. With car travel the cable is guided about the counterweight by the sheaves. An electrical contact, actuated in the event of an abnormal change in cable tension is used in a control circuit as an indication of counterweight derailment, thereby establishing the desired control response. An abnormal change in cable tension develops as a result of damage to the mechanical guide system of the counterweight, such as might be caused by earthquake forces on the building.

While not illustrated in the drawings, deflectors may be mounted on the counterweight to further insure that the cable 150, when released, does not get hung up or snagged on the counterweight system. However, by detecting an abnormal increase in cable tension, as well as detecting an abnormal decrease, the snagging problem is alleviated.

An important advantage of the present invention lies in the fact that the electrical wiring may be entirely confined to the motor or machine room; all hatch equipment is mechanical. No electrical traveling cables or batteries are required on the counterweight. Further, the disclosed system in a "non-destructive" detection system which may be easily reset by authorized personnel.

We claim as our invention:

1. An elevator system, comprising:

a building having a plurality of floors and a hoistway, an elevator car, a counterweight, means mounting said elevator car and said counterweight for guided vertical movement in the hoistway of said building, in adjacent vertical travel paths, motive means for driving said elevator car and said counterweight in their respective travel paths, cable guide means fixed to said counterweight, a cable strung in said hoistway, with said cable being reeved about the cable guide means on said counterweight, tension means providing a predetermined tension in said cable when the counterweight is mounted to operate in its normal vertical travel path, with said tension changing in response to an abnormal lateral deviation of said counterweight from its vertical travel path, and detector means responsive to the tension in said cable, said detector means modifying the operation of said motive means in response to a predetermined change in the tension in said cable.

2. The elevator system of claim 1 wherein the cable guide means includes sensor means for sensing an abnormal lateral deviation of the counterweight, and for reducing the tension in the cable in response thereto.

3. The elevator system of claim 1 wherein the cable guide means includes a split sheave biased to maintain the integrity theeof, and means responsive to an abnormal lateral division of the counterweight from its vertical travel path for overcoming the bias to release the cable from the split sheave and reduce the tension in the cable.

4. The elevator system of claim 1 wherein the tension means includes a spring member which is biased to a predetermined condition by the cable, and wherein the detector means is responsive to the tension in said cable by monitoring the condition of said spring member.

5. The elevator system of claim 1 wherein the tension means includes a spring member which is biased to a predetermined condition by the cable, and wherein the detector means includes a switch having an operating member responsive to the condition of said spring member.

6. The elevator system of claim 5 wherein the operating member of the switch is responsive to changes in the condition of the spring member which result from increases, and from decreases, in the tension of the cable.

7. The elevator system of claim 1 including first and second guide rails in the hoistway each having first and second parallel, opposed guide surfaces, and guide roller assemblies on the counterweight which co-act with said guide rails, and wherein the cable guide means includes a split sheave for receiving the cable, bias means for maintaining the integrity of the split sheave, rollers mounted for rotation against the guide surfaces of said first guide rail, and link members for linking the rollers and the split sheave, said rollers and link members overcoming the bias of the bias means to release the cable from the split sheave in response to predetermined horizontal movement of the counterweight relative to said first guide rail.

* * * * *